US005429320A

United States Patent [19]

Pack

[11] Patent Number: 5,429,320

[45] Date of Patent: Jul. 4, 1995

[54] DEVICE FOR CONTINUOUSLY WINDING WEBS OF FABRIC

[75] Inventor: Klaus Pack, Wiehl, Germany

[73] Assignee: Klockner ER-WE-PA GmbH, Erkrath, Germany

[21] Appl. No.: 125,686

[22] Filed: Sep. 24, 1993

[30] Foreign Application Priority Data

Sep. 26, 1992 [DE] Germany ..... 42 32 363.0

[51] Int. Cl.[6] ..... B65H 19/22

[52] U.S. Cl. ..... 242/533.5

[58] Field of Search ..... 242/533.4, 533.5, 533.6, 242/559.2

[56] References Cited

U.S. PATENT DOCUMENTS 3,433,429 3/1969 Schnitzspahn ..... 242/530.4
4,767,075 8/1988 Peters et al. ..... 242/533.5 X

FOREIGN PATENT DOCUMENTS 932151 7/1963 United Kingdom .
1177431 1/1970 United Kingdom .

*Primary Examiner*—John M. Jillions
*Attorney, Agent, or Firm*—Watson, Cole, Grindle & Watson

[57] ABSTRACT

A device is provided for continuously winding webs of fabric wherein one end of each of two winding shafts is connected permanently and force-lockingly to a respective rotary drive. The drive is connected permanently and force-lockingly to the elements of an automatic guide, which is attached to a single turning disk or plate which is held by the device on the drive side of the device. The shafts can be swivelled around a central axis of rotation of the turning disk or plate in order to move with respect to the central axis of rotation. The shafts can also move head-on constantly parallel to the central axis of rotation. The other end of each winding shaft represents an essentially free end which is held only for specified path distances by the guide elements. The device on the operator side of the device is designed in such a manner that it does not prevent removal of a finished roll of a web by means of a suitable transport device, for example, a lifting car, situated parallel to the axis of rotation of its winding shaft.

23 Claims, 7 Drawing Sheets

DEVICE FOR CONTINUOUSLY WINDING WEBS OF FABRIC

FIELD OF THE INVENTION

The present invention relates to a device for continuously winding webs of fabric. More particularly, the present invention relates to a device which does not prevent removal of a finish roll by a lifting device situated parallel to a winding shaft.

BACKGROUND OF THE INVENTION

Such a device is known, for example, from the European publication EP-PS 0 243 748 wherein a winding apparatus is disclosed in which a web of fabric, slit first by means of a longitudinal cutting device into several smaller parallel lengths, travels over a guide roller. The guide roller guides the individual webs alternatingly on an axis of rotation. The axis on which the webs are guided is on opposite sides of the winding device adjacent to the guide roller and oriented parallel to the axis of rotation of the guide roller. Each winding device comprises a winding shaft, which can be moved between two turning disks by means of linear guides and drives., disposed there, for their bearing arrangements—which also include the rotary drive of the winding shaft—on the horizontal diameter of these turning disks during continuous parallel positioning of their axis of rotation to the axis of the turning disks. At the same time, each pair of turning disks exhibits two such winding shafts, of which the one is moved, upon completion of the winding operation, with its axis of rotation into the axis of rotation of the turning disks. Then the other winding shaft, which is empty, is moved out of its furthest possible distance from the guide roller so as to rest against the latter by rotating the turning disks by 180°. Then a severing knife, which can be pivoted into the suitable web of fabric, for slitting the web is operated between both winding shafts, preferably in the immediate vicinity of the still empty winding shaft. The resulting end of the web is pulled on the spool. The resulting beginning of the web is pushed by means of a pressure roller coupled to the severing knife on the still empty winding shaft or a winding sleeve slid over the shaft in order to start a new roll. The winding shaft with the finished roll is moved to the maximum possible distance from the guide roller in order to remove the roll.

During the last phase of completing a roll and during its travel into the removal position, a swivellable feed roller rests against the roll and maintains a uniform winding density of the roll, even during the finishing segment.

The aforementioned device has a significant advantage over the prior art devices of this class, for example, the devices described in Great Britain Patent No. 932,151, U.S. Pat. No. 3,433,429 and Great Britain Patent No. 1,177,431. In the devices of these publications a rocker-like arrangement is used having a common axis of rotation arranged half-way between, and parallel to, the winding shafts. The rocker-like arrangement comprises two winding shafts arranged parallel and at a constant interval.

The drawback with this device is that it requires, first of all, a large number of mechanical mechanisms and individual parts for the parallel movement of the winding shafts. These parts are especially required to maintain the synchronism of both winding shaft drives. The parts requirement has an effect both on the amount of the production costs and that of the maintenance needs and costs for the device. In addition, to remove a completed roll from the device, the corresponding winding shaft must always be removed from the region of the winding disks, after both of the shaft's arrestable mountings have been detached and then removed from the roll. Removal requires a special, and expensive, winding shaft extraction machine. The machine has a weight of usually more than 100 Kg and a considerable length of usually at least 2.5 m. The extraction machine must be able to immediately, or at a later winding cycle, be inserted with the system running. The machine is needed for a freshly slid-on winding sleeve, or, without such a winding sleeve in arrestable mountings between the turning disks. Great care must be taken in the process or otherwise the risk of an accident to the operating personnel and apparatus rises significantly due to the bulky and heavy nature of the winding shaft and running system.

Therefore, the present invention is based on the problem of providing a device for continuously winding webs of fabric where the removal and insertion of the winding shafts is neither labor intensive nor expensive and there is a low risk of any damage and injury. Simultaneously, the number of mechanical mechanisms and individual parts is drastically reduced.

SUMMARY OF THE INVENTION

The present invention relates to a device which has one end of each winding shaft connected permanently and force-lockingly to a respective rotary drive. The drive in turn is connected permanently and force-lockingly to the elements of an automatic guide attached to a single turning disk or plate. The disk is held by the device on the drive side of the device. The present device makes it possible to move the winding shafts with respect to the axis of rotation of the turning disk, or parallel to the axis of rotation of the turning disk.

In another embodiment of the invention the other end of each winding shaft represents an essentially free end which is held only for specified path distances by guide elements attached to a support structure on the operator side of the device. Thus, the device of the invention does not prevent the removal of a finished roll by means of a suitable transport device parallel to the axis of rotation of the winding shaft from in the direction of the operator side of the device, for example, a lifting car.

It is possible to pull off the finished roll and optionally its winding sleeve inclusively immediately from the winding shaft by means of the transport device. The transport device can then carry it away for further processing. Also, the winding shaft can, if necessary, be equipped immediately with a new winding sleeve. The shaft may be equipped, for example, by hand or by means of an automatic sleeve loading system of the known kind.

The kind of winding sleeve to be used, prepared or nonprepared, depends solely on the kind of changing device, e.g., an arrangement which precedes the winding device under discussion and exhibits at least one guide roller and a severing device, with or without a pressure roller system. Optionally, the device can have a feed roller system of the known kind, which, however, can also be installed at the winding device itself under discussion, with which the present winding device is combined. In addition, in the device with the aforementioned features, the use of a second turning disk or plate is avoided. Also, any conceivable synchronizing device for the synchronous swivelling motion of two turning disks is advantageously avoided.

According to the present invention a simpler synchronous control is enabled between the drive side and the operator side of the device for the respective winding shaft while winding a web of fabric. On the operator side, only a motion control for the distance is necessary. The distance, fixed by the stationary support structure on the operator side of the device, is defined as from the starting position of the roll at the boundary with the related changing device up to the coincidence of the winding shaft with the axis of the rotation of the turning disk or plate.

It has also proven to be advantageous if the elements of the automatic guide at the turning disk or plate comprise rails and carriages. The rails, are installed force-lockingly or as one piece on the surface of the turning disk or plate. The carriages can be traversed and held on the rails. Each winding shaft, including its rotary drive, is a carriage. A linear drive assigned to each carriage can be operated parallel to the surface of the turning disk or plate. In this manner an especially straightforward, mechanically simple and inexpensive construction of the entire arrangement is obtained. The arrangement can be improved even more if the rails form a pair of rails which run symmetrically to a diameter of the turning disk or plate and over the major portion of the length of this diameter and on which both carriages are held movably.

Furthermore, it can also be viewed as advantageous that the pair of rails include an opening, extending parallel to the diameter of the turning disk or plate over the major portion of the length of this diameter. This is particularly advantageous because together with the pair of rails, the carriages, linear drive and rotary drive of the winding shafts are disposed on the side of the turning disk that faces away from the roll. Also, the winding shafts in interaction with their related carriage and rotary drive, project through the opening into the space for the roll to be produced. The design results not only in a straightforward construction of the device, but also in a better distribution of weight between a winding shaft provided with a roll and its drive and guide elements relative to the mounting of the turning disk.

In one embodiment of the invention it has also proven to be advantageous if the linear drives are pneumatically or hydraulically operable piston-cylinder arrangements, which are attached force-lockingly to the surface of the turning disk. These drives are well-known and proven units whose use causes no problems.

In contrast, in another embodiment it may be regarded as especially advantageous that the linear drives are combinations, which are installed stationarily on the surface of the turning disk and comprise an electric servomotor and a rotatable threaded rod, because these drives are also not only well-known and proven, but also can be controlled in an especially simple manner, namely electrically. This feature is especially advantageous if other drives, for example, on the operator side of the device, have to be controlled synchronously with the aforementioned drives. The same applies in an advantageous manner to the case in which the rotary drives of the winding shafts are electric direct current motors.

The result is especially advantageous for the device according to the invention, in particular when the energy supply for the rotary drives of the winding shafts and the linear drives of their carriages occurs via a slip ring system. The slip ring system is supported by a bracket, which is mounted stationarily on the surface of the turning disk or plate that faces away from the spool and bridges all of the drive and guide elements. In this manner, any cables, hoses or other energy feed systems subsequently executing the rotational motions of the turning disk are reliably avoided.

It may also be regarded as advantageous for the embodiment of the device according to the invention that the guide elements are attached to a support structure on the operator side of the device and guide the free ends of the winding shafts. The guide elements include guide rails which can be connected in such a manner to the device that they can intercept, at any time, forces acting on them from the free ends of the winding shafts and can transfer the forces to the device. This provides a simple and inexpensive possibility of intercepting the forces attacking at the free ends of the winding shafts, directly or via moveable intermediate elements, and allowing the movement of these ends of the winding shafts, at least with respect to their respective distance over the bottom or foundation supporting the device, to progress in a controlled manner. This is accomplished in an especially simple and straightforward manner if the guide rails run parallel to the planned path of each winding shaft while winding a web of fabric, particularly if the guide rails run horizontally.

An advantageous improvement according to the invention also results from designing the guide rails, at least section-by-section, on the inside and outside of the device as a pair of rails. The rails are connected as one piece, or force-lockingly, to the surfaces of the device. Each of the rails carries and holds a holding carriage, which can move on the pair of rails. In this manner the defined introduction of the forces, exerted on a foundation by the free end of the winding shafts, is transferred into the device. The unimpeded drag movement of the free end of each winding shaft with the automatic displacement exerted on the winding shaft on the drive side is guaranteed. This also enables undisturbed changing of the holding carriages from the starting position, for winding a web of fabric, up to at least below the axis of rotation of the winding disk.

The control of the sequence of movement of the free end of each winding shaft parallel to the automatic displacement of the same winding shaft on the drive side of the device can be achieved in an especially advantageous manner. This is possible if each holding carriage is moved by a separate linear drive which can be operated parallel to the longitudinal direction of the rails and which can then be synchronized in a well-known manner to the corresponding linear drive on the drive side of the device for the same winding shaft.

In a specific embodiment of the invention it has proven to be advantageous if the linear drives are pneumatically or hydraulically operated piston-cylinder arrangements. These known and proven units do not present any serious problem, even if they have to be balanced with one or more identical units.

In another embodiment of the invention it has been proven to be especially advantageous if the linear drives are combinations, which are installed stationarily on the surfaces of the device and comprise an electric servomotor and a rotatable threaded rod. This is because the synchronization with one or more identical linear drives is accomplished in an especially easy manner, for example, by way of program control.

An advantageous embodiment of the device according to the invention is also one in which the free end of each winding shaft is constantly located within the space, stretched on the device, for winding a web of fabric. Therefore, each holding carriage carries a bracket, which projects into the aforementioned space and which is designed in such a manner that the brackets of both carriages are not impeded during their travel motions. This results from the fact that such a device allows them to be operated not only together with the changing devices which feed the web of fabric from the top to the winding shaft, but also together with changing devices which allow the web of fabric to run from the bottom onto the winding shaft. Feeding the web of fabric from the top to the winding shaft is a process that then demands the turning disk to swivel in such a manner that the winding shaft to be freshly wound is moved from the bottom to the start position. Feeding the web of fabric from the bottom onto the winding shaft requires that the winding shaft, to be freshly wound, be moved from the top of the start position by means of the swivelling motion of the turning disk.

Furthermore, another advantageous embodiment of the invention is one in which the top side of each holding carriage exhibits a known class of detachable stopping device, which can be operated in interaction with the free end of each winding shaft. The control of the synchronous displacement of the free end of each winding shaft with its end, which is automatically displaced on the drive side of the device, can be further improved and rendered more accurate with the stopping device.

In another embodiment of the invention a segment of the guide rails is designed as a pivotable boom forming an extension of the guide rails. The extendable boom can be folded in and out by means of a suitable extendable support in the form of a retraction and extension mechanism. Preferably, the pivotable boom bridges an opening-like cutout in the device on the operator side of the device. This enables the possibility of positioning a finished roll within the device in such a manner that, for example, a lifting car can drive under said roll without being impeded by a transport device. Also, the pivotable boom can be folded down after the transport device has made contact with the roll in a subsequent step. That way, the transport device can move with the roll without hindrance parallel to the longitudinal axis of the winding shaft in the direction of the operator side of the device out of the device. At the same time, significantly less space is required in an advantageous manner if the extendable support is retracted and extended parallel to the longitudinal axis of the rail, thus resulting in the extendable support being retracted and extended in an especially easy and advantageous manner. The movement is especially facilitated when the retracting and extending mechanism is formed by a pneumatically or hydraulically operable piston-cylinder arrangement mounted on the device.

In another embodiment of the invention one part of the device on the operator side of the device, including the segments of the guide rails connected thereto, is connected detachably to the rest of the device and force-lockingly to a movable lifting car. In the state of locking the aforementioned part to the rest of the device within the space for winding stretched by the device, a web of fabric is arranged in such a manner that it is positioned in the aforementioned space ready to receive below the provided removal position of a finished roll. This is because it provides an especially easy procedure to position a suitable transport device interaction with the removal position for the finished roll of a web of fabric within the device. Also, it is easy to pull off and transport away the roll without being impeded by the winding shaft. At the same time the result is an especially advantageous arrangement, if that part of the device that is connected detachably to the rest of the device is disposed with the lifting car in such a manner within the device that the longitudinal axis of the lifting car is oriented parallel to the axis of rotation of the turning disk and vertically below this axis of rotation. A minimum displacement path of the roll within the device according to the invention is obtained. This feature advantageously reduces both the investment and the operating expenses, and in particular, the amount of energy consumed.

Another embodiment of the invention may also be regarded as advantageous if the entire device is mounted on a system of slide rails and/or rollers and is provided with an oscillator drive mounted on the foundation of the workshop, for example, an eccentric drive or a pneumatically or hydraulically operable piston-cylinder arrangement. The device is mounted in such a manner that while winding a web of fabric it oscillates in the cm range vertically to the conveying direction of the web of fabric, thus virtually preventing the formation of concave rolls in frequently existing webs of fabric with more or less reinforced edge regions.

BRIEF DESCRIPTION OF THE DRAWINGS

Embodiments of the subject matter of the invention are further explained with reference to the following drawings, wherein.

DETAILED DESCRIPTION OF THE INVENTION

Figure 1:
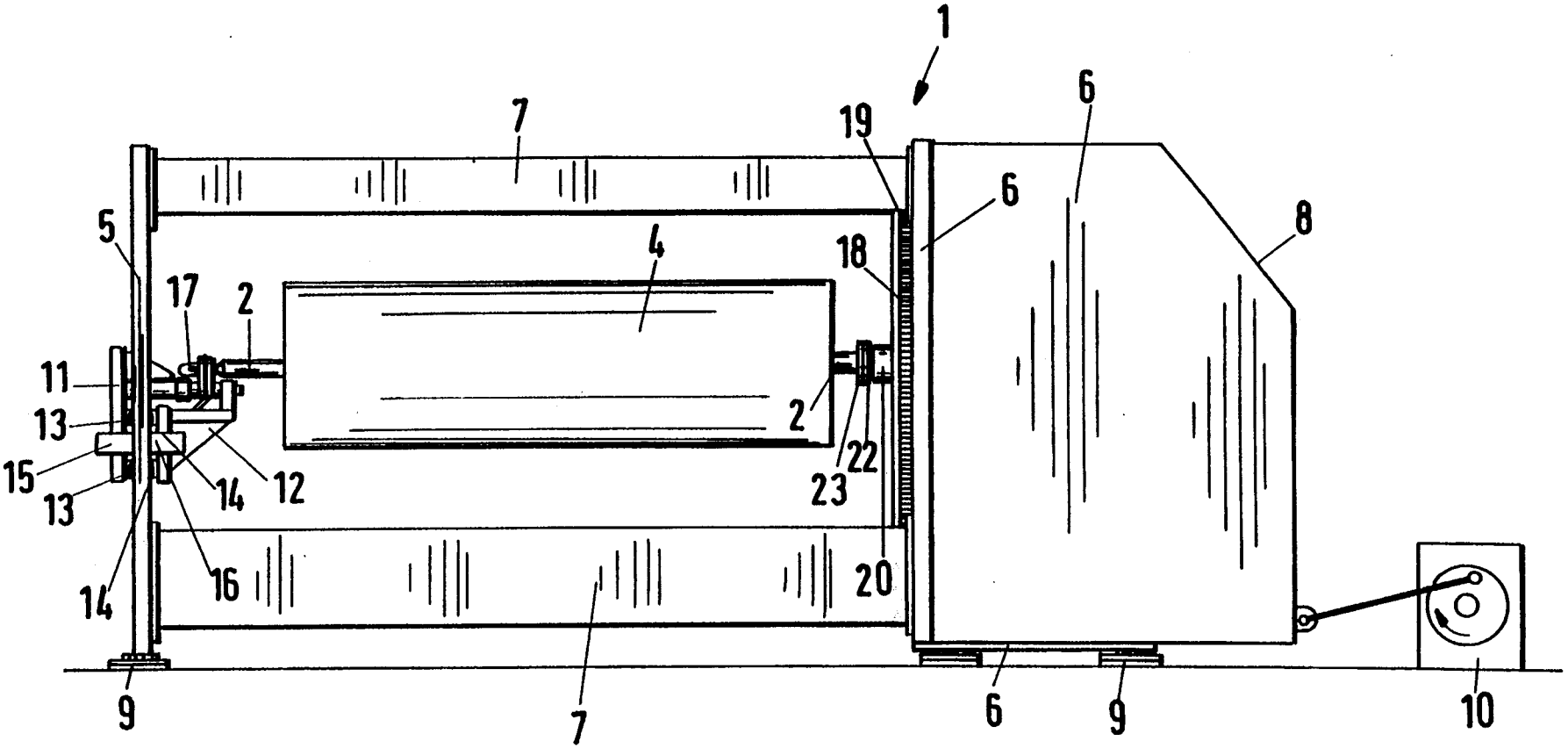
FIG. 1 is a side view of the device according to the invention from the feed side of the web of fabric.

FIG. 1 shows a side view of a device 1 according to the invention from the feed side of the web of fabric (not explicitly shown here). In the operating state of the device, the device is placed directly at a changing device of the known kind (also not explicitly shown here). The device 1 can interact with changing devices which can deliver the web of fabric from either the top or from the bottom to the winding roll 2. The device can demand the input of both prepared and non-prepared winding sleeves or, optionally, no winding sleeves at all. The changing device usually includes at least one guide roller and a severing device, with or without a pressure roller system. Optionally, the changing device may also include a feed roller system for at least the last phase of producing a roll 4 and optionally for further displacing the roll into its removal position, which can, however, also be installed at the winding device itself under discussion.

The device 1 comprises a two part device 5, 6, whose two parts are arranged on the operator side and on the drive side of the device 1, respectively. A stable connection between parts 5 and 6 is produced by cross members 7. One part 6 of the device on the drive side of the device 1 is formed as a housing box 8. The entire device 1 is mounted on a system of slide rails and/or rollers 9, on which it can be set oscillating with respect to the locally mounted changing device (not illustrated) transversely to the conveying direction of the web of fabric. Such an oscillating drive helps avoid the formation of concave rolls 4 in the case of a winding web of fabric with more or less reinforced edge regions. The oscillating motion may be produced by means of an oscillator drive, for example, by means of an eccentric drive 10.

The part of the device 5 on the operating side of the device 1 is a support structure which supports two holding carriages 11, 12, which can be moved with separate linear drives, for example, servomotors 15, 16. The carriages are supported by means of pairs of rails 13, 14 attached laterally to said support structure 5. The servomotors may comprise rotated threaded rods (not visible here), as or with the pairs of rails 13, 14 in the horizontal direction. At the same time, the linear drives can naturally also be implemented by other means that act in the same manner, for example, by means of pneumatically or hydraulically operable piston-cylinder arrangements. The holding carriages 11, 12 are designed in such a manner, as will be explained in still greater detail with reference to FIG. 3, that they will carry and hold a free end 17 of a winding shaft 2 within the space between the support structure 5 on the operator side of the device and the drive part 6 on the drive side of the device.

Figure 2:
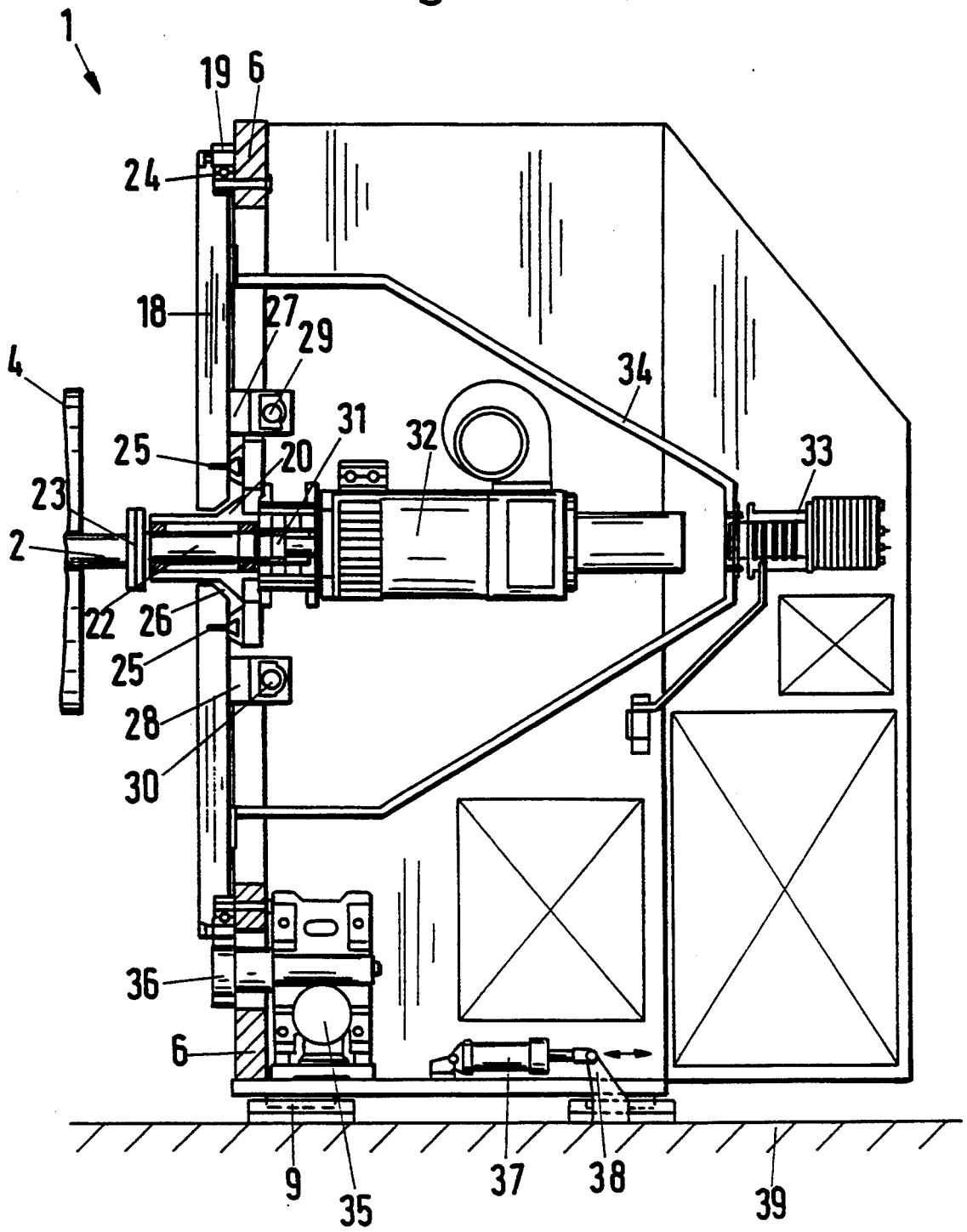
FIG. 2 is a vertical view of the axis of rotation of the turning disk or plate on the drive side of the device according to FIG. 1, which coincides here simultaneously with the longitudinal axis of the winding shaft.

The part 6 on the drive side carries and holds a turning disk or support plate 18, which, in the present case and also in the other cases shown in FIGS. 2 to 7, is depicted as a substantially rotationally symmetrical disk with an outer toothed rim 19. The toothed rim allows the turning disk 18 to be operated by means of a motor or pinion arrangement, a detail of which is shown in FIG. 2. In special cases the turning disk can naturally be constructed as a non-rotationally symmetrical turning plate, which has to be swivelled then by means of another drive of a known kind, for example, by way of a bridge arrangement with an axially symmetrical drive. Through an opening in the turning disk 18 projects a carriage 20, which is disposed essentially inside the housing box 8 and through which an output shaft 22 for the rotary drive of the winding shaft 2 extends. The winding shaft 2 is attached permanently and preferably force-lockingly to the output shaft 22 by means of a flange connection 23.

FIG. 2 is a vertical view of the axis of rotation of the turning disk 18. Here the view coincides simultaneously with the longitudinal axis of the winding shaft 2. The part 6 on the drive side of the device 1 holds and carries the turning disk 18 with the outer toothed rim 19 by means of a known cross roller bearing 24. The turning disk 18 in turn holds and carries altogether two carriages 20, 21, of which only one is visible here, by means of a pair of rails 25. The pair of rails 25 extends symmetrically to an oblong opening 26 in the turning disk 18, which in turn extends symmetrically to a diameter of the turning disk 18. Here, too, the carriages 20, 21 are driven along this pair of rails 25 by means of a linear drive combination comprising servomotors 27, 28 and threaded rods 29, 30, both of which can be recognized in the present drawing, but could also be accomplished with other equivalent means, for example, by means of pneumatically or hydraulically operable piston-cylinder arrangements. However, it has been proven to be very advantageous in the present case to control the carriage synchronously with the same holding carriage supporting the winding shaft at the support structure 5 on the operator side of the device 1, a feature that can be implemented the simplest electrically, for example, by means of program control. The carriage carries the corresponding winding shaft during the production of a roll and the associated transport of the winding shaft from the start position to the boundary of the changing device until coincident with the axis of rotation of the turning disk 18.

Like the carriage 21, which is not shown, the carriage 20 carries a d.c. motor 31 with a cool air fan 32 as the rotary drive for the winding shaft 2. The shaft 2 is connected force-lockingly and permanently to the motor drive shaft 22 by way of the flange connection 23. The energy for all of the drive elements is supplied on the backside of the turning disk 18 by way of a slip ring system 32, which is attached to the rearward end of a bracket 34, connected force-lockingly to the rearside of the turning disk 18.

The drive of the turning motion of the turning disk 18 is accomplished via the outer toothed rim 19 by means of an electric motor 35 and a pinion 36. For the oscillating motion of the device 1 transversely to the feed direction of the web of fabric (not illustrated) a pneumatically or hydraulically operable piston-cylinder arrangement 37 is used here. The arrangement shown in FIG. 2, in contrast to the arrangement in FIG. 1, is connected force-lockingly by way of an anchor 38 to the bottom or foundation 39 supporting the device 1.

Reference numerals that have not been specifically mentioned correspond to those of FIG. 1. Components that are identical to those in FIG. 1 have the same reference numeral as in FIG. 1.

Figure 3:
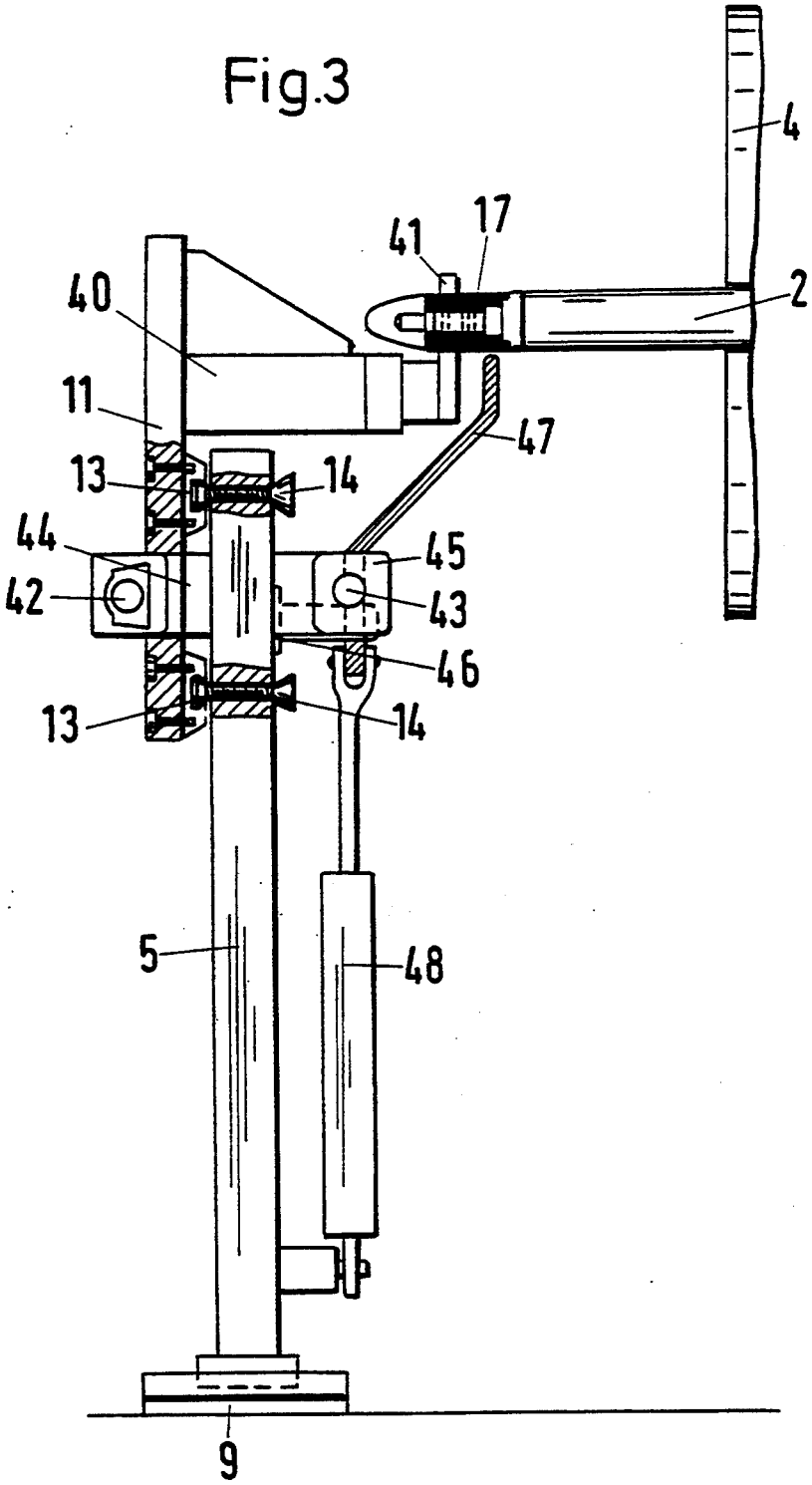
FIG. 3 is the same view as in FIG. 2 of the operator side of the device, partially cut away.

FIG. 3 is a vertical view of the axis of rotation of the turning disk 18 on the operator side of the device 1, wherein, here too the view is chosen in such a manner that the aforementioned axis of rotation coincides with the longitudinal axis of a wind shaft 2. It can be seen that the device 5 on the operator side of the device 1 exhibits a different height compared to that in FIG. 1, a feature that results from the features described in connection with FIG. 4 described below. In addition to FIG. 1, it is easier to recognize here that the holding carriages, of which only the holding carriage 11 is depicted, forms a knee, which is achieved by means of a bracket 40. This bracket 40 supports in turn a detachable stopping device 41, with which the free end 17 of winding shaft 2 is held shape-lockingly on the carriage 11 (or 12) during the non-forceless production of roll 4. In addition, FIG. 3 shows, as compared to FIG. 1, the threaded rods 42, 43 and the bearing blocks 44, 45, which are concealed there by the servomotors 15 and 16.

Behind the bearing block 45, related to the holding carriage 12 (not illustrated) for the threaded rod 43, one can recognize rotary mounting 46, to which a pivotable boom 47 is pivotally mounted. The pivotable boom can be folded down as an extension of the pair of rails 25 by means of a pneumatically or hydraulically operable piston-cylinder arrangement 48, when the finished roll 4 is to be moved from the final position of the winding operation. This means that the longitudinal axis of the winding shaft 2 conforms with the axis of rotation of the winding disk 18, into another removal position, a process that follows clearly from the following FIG. 4. The pivotable boom 47 is also bent at right angles to its longitudinal axis, in order to adapt to the position of the free end 17 of the winding shaft 2, whose illustrated spatial position allows the turning disk 18 to turn both clockwise and counterclockwise. This procedure allows the incoming web of fabric to be delivered from the top or from the bottom to the respective winding shaft.

Reference numerals that have not been specifically mentioned correspond to those of the previous Figures. Components that are identical to those in the previous Figures have the same reference numerals as in the previous figures.

Figure 4:
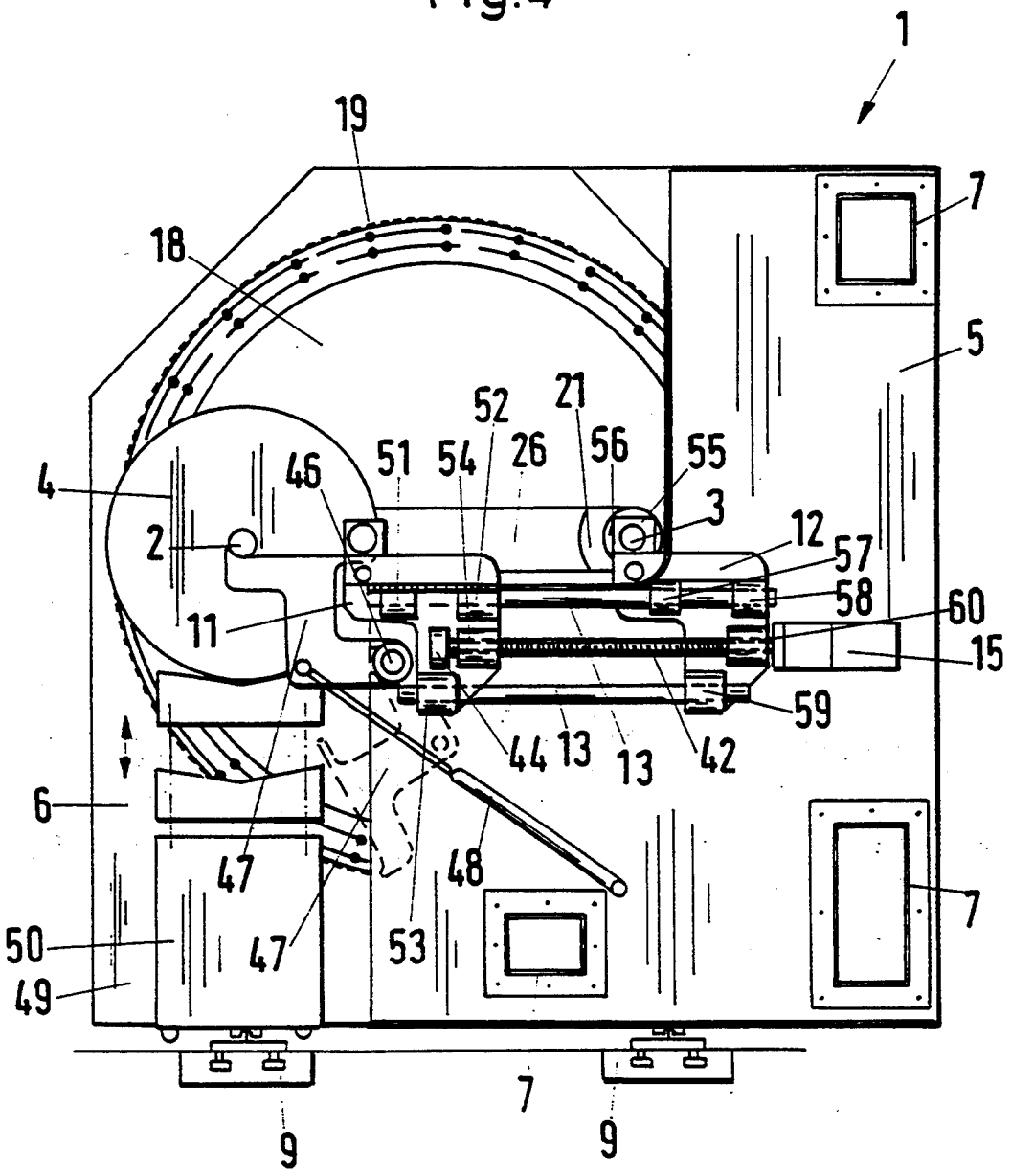
FIG. 4 is a side view of the device according to FIG. 1 starting from the operator side of the complete device, partially cut away, showing particular parts of the device between the device on the operator side and on the drive side.

FIG. 4 is a side view of the complete device 1 from the operator side. First, it follows that the device 5 on the operator side exhibits different heights in different regions. It exhibits the maximum height in the immediate vicinity of the related changing device (not shown here), in order to receive here several cross members 7. In a central region it is exactly so high that the outer holding carriage 11 with its bracket 40 can travel over the device 5 in such a manner that said device can also receive the winding shaft 2, 3 to be supported exactly at the correct height. In the left region the device 5 shows a cutout 49, which reaches to the floor and into which a severing device, for example a traversable lifting car 50, can travel, and receive there a finished roll 4. The lifting car 50 is depicted in its driven in and its driven out position. The possible movement is symbolized by means of the nearby arrow. The traversability is shown symbolically by means of the transport rollers drawn at the bottom.

On the front side of the device 8 is mounted force-lockingly the servomotor 15, which actuates the threaded rod 42 braced at the other end in the bearing block 44. In addition, one can see here the pair of rails 13, on which the holding carriage 11 is traversed. This holding carriage 11 exhibits rail shoes 51, 52 and 53 and a threaded block 54. Similarly, the holding carriage 12 exhibits rail shoes 57, 58 and 59 and a threaded block 60. The holding carriage 12 has its pair of rails 14, servomotor 16, threaded rod 43 and bearing block 45 lying symmetrically behind the corresponding parts for the holding carriage 11. In addition, one can recognize the arrangement of the pivotable boom 47, particularly in both the folded in and stretched out state, including the related piston-cylinder arrangement 48. Furthermore, one can recognize a roll 4, which sits on the winding shaft 2. Upon finishing the roll, the shaft was conveyed first out of the final position of the roll, in which its longitudinal axis agrees with the axis of rotation of the turning disk 18, as far as the transfer point to the pivotable boom 47. Once conveyed to the pivotable boom, it is released by the detachable stopping device 41 and subsequently pushed by its displacement drive (not visible here) on the drive side of the device 1 (see FIG. 5) into the illustrated removal position at the currently left end of the opening 26.

In contrast, the second winding shaft 3 is moved at that time when the winding shaft 2 is still with its longitudinal axis in the axis of rotation of the turning disk 18. The second shaft 3 is moved by swivelling the turning disk out of the then current position of the winding shaft 2 into the start position shown now, making contact with the related changing device (not illustrated) and received there by the detachable stopping device 55 of the holding carriage 12. The carriage 12 is moved at this stage together with the new roll in the direction of the final position for producing the roll 4.

One part of the carriage 21 with the direct current motor 56 can still be recognized in the opening 26. In addition, the drawing also shows parts of the device 6 on the drive side of the device 1 and the turning disk 18 with the outer toothed rim 19.

Figure 5:
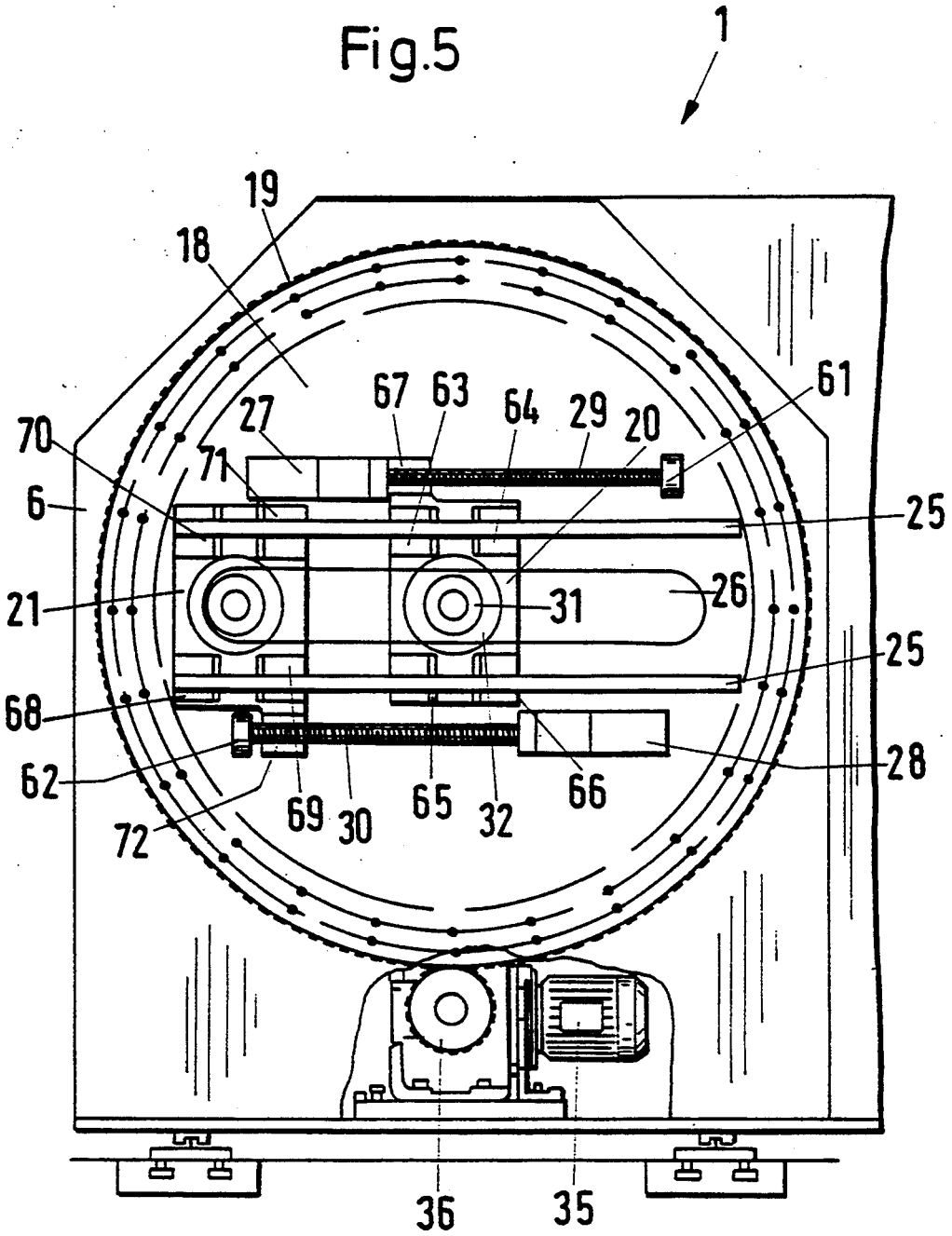
FIG. 5 is the same view as in FIG. 4 with the device exposed on the drive side, showing particular parts of the device behind the device on the drive side.

FIG. 5 shows the device 1 from the same viewing direction as FIG. 4, but with the drive side of the device 1 exposed by partial cut-away. First, the part 6 on tile drive side of the device, the turning disk 18 with the outer toothed rim 19 and the opening 26 can be recognized. Behind the turning disk, corresponding to FIG. 2, the pair of rails 25 with the carriages 20, 21, the servomotors 27, 28, the threaded rods 29, 30 and the bearing blocks 61, 62 of these threaded rods, can be recognized. In addition, the drawing shows that the carriages 20, 21 exhibit four rail shoes 63, 64, 65 and 66 or 68, 69, 70 and 71 and one threaded block 67 or 72, each for receiving the respective threaded rod 29, 30.

Each carriage carries a direct current motor 31 or 56 with a related cool air fan 32 or 79. With these arrangements the winding shafts 2 and 3 can be moved in any case from one end of the opening 26 to the axis of rotation of the turning disk 18. The motor 35 and the pinion 36 for swivelling the turning disk 18 by means of the outer toothed rim 19 are also shown.

Figure 6:
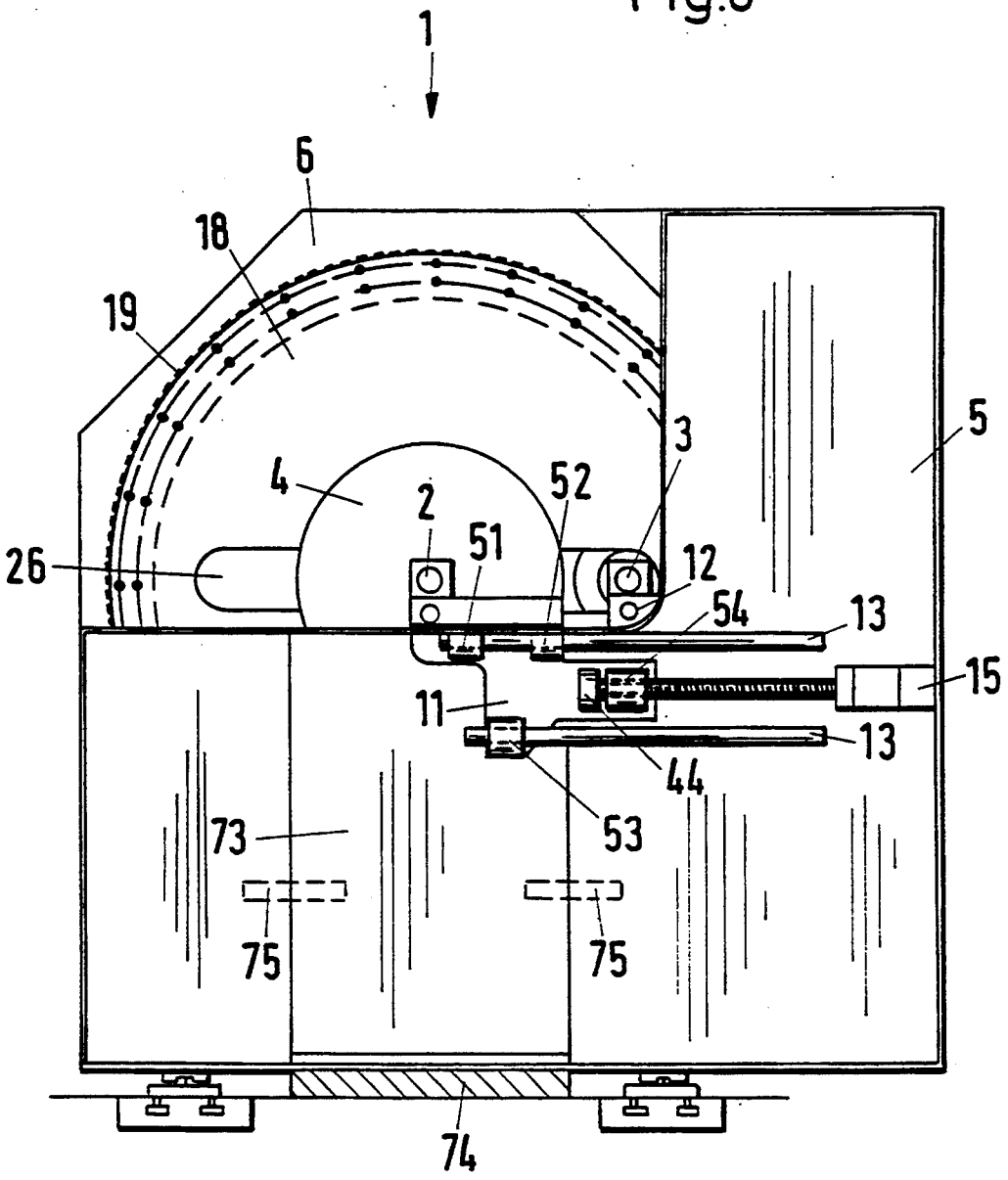
FIG. 6 is a view of another embodiment; of the device on the operator side of the device according to FIG. 1.
Figure 7:
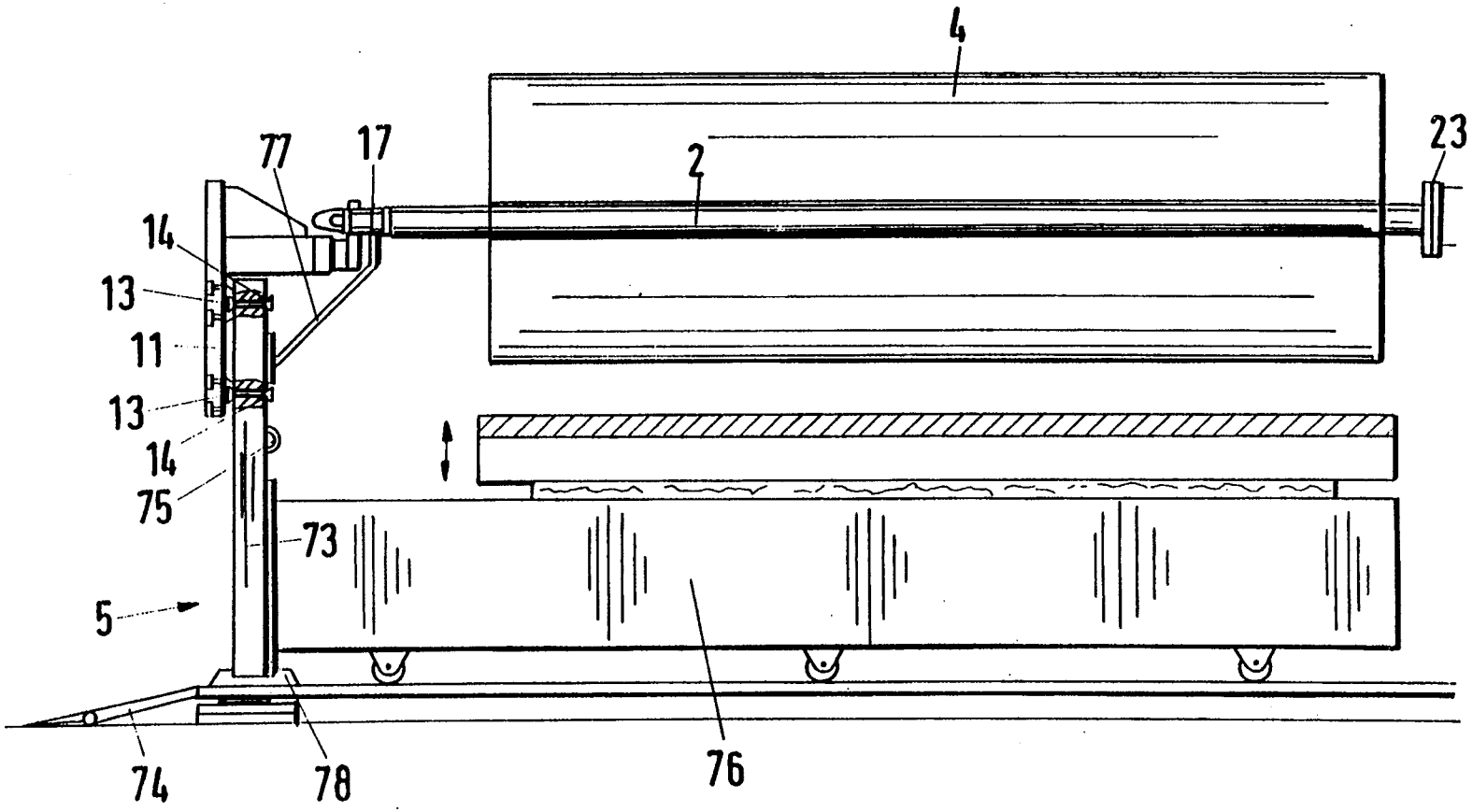
FIG. 7 is a sectional view of the axis of rotation of the turning disk representing here simultaneously the axis of rotation of the winding shaft, with respect to the device of FIG. 6, in the region from the operator side to the drive side.

FIG. 6 depicts another embodiment of the device 5 on the operator side of the device 1. Here the device 5 is designed continuously over the entire width, but its central part 73 is connected only detachably to the rest of the support structure 5 and can be removed from said device, for example, in connection with a lifting car attached thereto as shown in FIG. 7. A corresponding modification of the arrangement of the holding carriages 11, 12 of the pairs of rails 13, 14, the servomotors 15, 16, including the threaded rods 42, 43 and the bearing blocks 44, 45, does not present a problem. In addition, possibilities for moving the lifting car, for example, in the form of a ramp 74 may be installed. Locking devices 75 of the known kind also must be installed.

FIG. 7 is a vertical view of the axis of rotation of the turning disk 18 with respect to the device 1 of FIG. 6 in the region between the operator side and the drive side of the device 1. The removable part 73 of the support structure 5 depicted here is connected force-lockingly to a lifting car 76. With the lifting car, the part 73 can be moved out of the whole device 1 via the ramp 74 or an identically functioning device, after the locking device 75 of the known kind has been unlocked and the finished roll 4 is received. After a new winding sleeve has been slid on the winding shaft 2, for example, by hand or by means of an automatic sleeve loading system, and the lifting car 76 is driven in again by means of a threading system 78 of the known kind, the winding shaft 2 can be moved on the slide rail 77.

The shape of the slide rail 77 has been adapted to not exhibit an additional support and is attached force-lockingly to the stationary rear part of the support structure 5. Optionally, the slide rail 77 is also attached to the removable central part 73. This enables the slide rail to be able to move, as desired, from there by means of the turning disk 18 again into the start position for the purpose of producing again a roll 4. The rails under discussion can be split at the seams between the removable central part 73 and the rest of the support structure 5 without any difficulty.

The following production process for a roll of fabric is implemented with any conceivable embodiment of the subject matter of the present invention described above.

First, a winding shaft, provided with a suitable winding sleeve, or, at least in special cases, not equipped with a winding sleeve, is brought into contact with a guide roller of a changing device of the known kind. The contact is brought about by means of its related carriage and its linear drive on the drive side of the device and by means of the turning disk or plate. The free end of the winding shaft is braced against a holding carriage on the operator side of the device and grasped by its detachable stopping device. The rotary drive of the winding shaft is set into motion and the start of the web of fabric to be wound by means of a suitable pressure roller system of the changing device or another suitable measure of the known kind is conveyed on the winding shaft and attached there so as not to slip. The attachment may be made, for example, by means of cementing or clamping. Subsequently, the roll is produced and at the same time the winding shaft is moved by means of the related carriage and its linear drive and the synchronously controlled holding carriage and its linear drive.

In such manner, the winding shaft is moved in the direction of the axis of rotation of the turning disk such that the resulting roll always rests against the aforementioned guide roller of the changing device. Shortly before reaching the anticipated final circumference of the roll, its winding shaft is then moved immediately into the axis of rotation of the turning disk. In this process, a feed roller system of a known kind is normally applied beforehand, depending on the size of the roll, to the roll and exerts constant feed pressure in order to maintain uniform winding density on the roll. This feed roller system of the known kind can be either a part of the changing device or also a part of the winding device, according to the invention. The feed roller system may be used in the previous designs without restricting universality.

When the winding shaft of the almost finished roll has reached the position of the axis of rotation of the turning disk or plate, the latter is swivelled by 180°. This moves the second ready-for-use winding shaft, which is parked until then by means of its related carriage and its linear drive at its furthest point from the changing device, into the requisite contact position at the aforementioned guide roller of the holding carriage. This fixes its free end detachably on the second holding carriage and allows its related rotary drive to be put into action. Finally, the web of material is suddenly severed transversely to its direction of transport by means of a severing device of the known kind, which is a normal component of the changing device. The outgoing end is pulled on the finished roll and the freshly produced start of the web of material is applied on the empty winding shaft by means of a suitable pressure roller system of the changing device or other suitable measures and attached so as not to slip. In this way, one can start immediately with the production of a new roll in the manner described above.

At this stage, the rotary drive of the winding shaft of the finished roll is put out of service. The feed roller system is moved back into its starting position. The free end of the winding shaft under discussion is released, by the detachable stopping device, of its related holding carriage and the roll that has come to rest is moved into the anticipated removal position by means of its related carriage and its linear drive on the drive side of the device. Optionally, the pivotable boom is used on the operator side of the device, provided such a displacement is necessary (cf. FIG. 4) or not (cf. FIG. 6). In the removal position, the roll is then received by a suitable transport device, for example, an adapted lifting car, and pulled from the winding shaft with a transport movement parallel to the related winding shaft. Subsequently, the roll is conveyed to a treatment system. The now empty winding shaft is provided, if necessary, with a new winding sleeve in a suitable manner, for example, by hand or by means of an automatic sleeve loading system. These sleeves can also consist of several special sub-elements, and can then be moved by means of their related carriage and their linear drive into their park position at the furthest point from the changing device. The sleeve can then be available for further use (see above). Of course, the equipping of the winding shaft with a new sleeve and the travel into its park position can also be done in the reverse order. The holding carriage of the latter winding shaft on the operator side of the device is moved back in the interim into its starting position in the immediate vicinity of the changing device without impeding the other holding carriage.

Although the present invention has been described in connection with preferred embodiments, it will be appreciated by those skilled in the art that additions, modifications, substitutions and deletions not specifically described may be made without departing from the spirit and scope of the invention defined in the appended claims.

What is claimed is:

1. A device for continuously winding a web of material, comprising two parallel winding shafts each having a separate rotary drive connected at one end thereof, said winding shafts being arranged on and lying perpendicular to a rotatable support plate located at a drive side of said device, means for rotating said support plate about a central axis thereof, each said winding shaft lying perpendicular to said support plate and extending toward a support structure located at an operator side of the device, at least one of the shafts lying parallel to and spaced from the central axis such that rotation of the support plate causes the at least one shaft to revolve about the central axis, first guide means mounted on the support plate for moving said shafts and the rotary drives attached thereto in a plane perpendicular to the support plate, second guide means mounted on said support structure for moving an opposing end of each shaft in the perpendicular plane while the shafts remain parallel, the opposing ends moving away from the second guide means upon rotation of the support plate to permit removal of a wound roll from said at least one shaft in a direction parallel to the shafts.

2. A device as defined in claim 1, wherein said first guide means comprises a rail attached to said support plate, and a carriage for each winding shaft movable along said rail, each winding shaft and its respective rotary drive being mounted on one said carriage, each carriage having linear drive means for driving the respective carriage along the support plate.

3. A device as defined in claim 2, wherein said first guide means comprises a pair of rails respectively located an equal distance on opposite sides of a line bisecting the support plate, each said carriage being movable along said rails.

4. A device as defined in claim 3, wherein the support plate has an elongate opening and the pair of rails are respectively located on opposite sides of said opening, the elongated dimension of said opening extending parallel to the line bisecting the support plate and over the major portion of the length of the line, said pair of rails, said carriages, said linear drive means and said rotary drives of the winding shafts are disposed on one side of the support plate and the winding shafts are disposed on the opposite side of the support plate.

5. A device as defined in claim 2, wherein the linear drive means comprise pneumatically operable piston-cylinder arrangements mounted on the support plate.

6. A device as defined in claim 2, wherein the linear drive means comprise hydraulically operable piston-cylinder arrangements mounted on the support plate.

7. A device as defined in claim 2, wherein each said linear drive means comprises an electric servomotor and a rotatable threaded rod mounted on the support plate.

8. A device as defined in claim 1, wherein each said rotary drive comprises an electric direct current motor.

9. A device as defined in claim 1, wherein said second guide means includes second guide rails connected to the support structure.

10. A device as defined in claim 9, wherein the second guide means are synchronously driven with said first guide means while a web of material is winding to maintain said winding shafts parallel.

11. A device as defined in claim 9, wherein the second guide rails extend horizontally.

12. A device as defined in claim 9, including a support carriage for supporting said opposing end of a respective winding shaft at the operator side of said device, said support carriage being movable along said second guide rails.

13. A device as defined in claim 12, wherein each support carriage is driven by a separate second linear drive means which moves said support carriage along the second guide rails.

14. A device as defined in claim 13, wherein each said second linear drive means comprises a pneumatically operated piston-cylinder arrangement.

15. A device as defined in claim 13, wherein each said second linear drive means comprises a hydraulically operated piston-cylinder arrangement.

16. A device as defined in claim 13, wherein each said second linear drive means comprises an electric servomotor and a rotatable threaded rod.

17. A device as defined in claim 12, wherein each support carriage includes a detachable stopping device for stopping rotation of said respective winding shaft.

18. A device as defined in claim 9, further comprising a pivotable boom forming an extension of said second guide rails, and an extendable support for said pivotable boom, wherein each extendable support is retracted and extended parallel to the longitudinal axis of the second guide rails.

19. A device as defined in claim 18, wherein the extendable support means includes a pneumatically operable piston-cylinder arrangement mounted on the support structure.

20. A device as defined in claim 18, wherein the extendable support means includes a hydraulically operable piston-cylinder arrangement mounted on the support structure.

21. A device as defined in claim 1, wherein a portion of the support structure is connected to a roll transfer device and is detachably connected to the rest of the support structure, said portion being detachable from the rest of support structure to remove a finished roll from the device.

22. A device as defined in claim 21, wherein said portion is connected to the roll transfer device such that the longitudinal axis of the roll transfer device is oriented parallel to and vertically below the axis of rotation of the support plate.

23. A device as defined in claim 1, wherein said device is movably mounted on an oscillating system which includes an oscillatory drive means to oscillate a web of material transversely with respect to the winding direction of the web.

* * * * *